US006401356B1

(12) United States Patent
Churchland et al.

(10) Patent No.: US 6,401,356 B1
(45) Date of Patent: Jun. 11, 2002

(54) METHOD OF DRYING WOOD VENEER

(75) Inventors: Mark Trelawny Churchland; Robert Leeson Pike, both of Vancouver; Norbert Kott, Fort Langley, all of (CA)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/906,639

(22) Filed: Jul. 18, 2001

(51) Int. Cl.[7] ..... F26B 3/28; B27L 5/00

(52) U.S. Cl. ..... 34/255; 34/259; 34/419; 34/420; 34/421; 34/445; 144/2.1

(58) Field of Search ..... 34/255, 259, 273, 34/306, 418, 419, 420, 421, 422, 443, 444, 445, 446, 447, 459, 611, 618, 619, 620, 116; 144/2.1, 364, 362; 100/312; 271/306

(56) References Cited

U.S. PATENT DOCUMENTS 2,694,570 A * 11/1954 De Lano
3,963,552 A * 6/1976 Troutner et al.
4,018,642 A * 4/1977 Pike et al.
4,179,820 A * 12/1979 Steffensen et al.
4,193,207 A * 3/1980 Allen et al.
4,456,498 A * 6/1984 Churchland
4,486,963 A * 12/1984 Koike et al.
4,797,169 A * 1/1989 Aizawa
4,945,652 A * 8/1990 Clarke et al.
5,662,760 A * 9/1997 Tsuda
5,743,026 A * 4/1998 Cremona
6,201,224 B1 * 3/2001 Churchland et al.
6,213,010 B1 * 4/2001 Bolzoni

* cited by examiner

*Primary Examiner*—Ira S. Lazarus
*Assistant Examiner*—K. B. Rinehart

(57) ABSTRACT

A method of drying veneer sheets by continuously shingling discrete wood veneer-sheets to form a layup where the leading edges of adjacent sheets are offset by a distance X with the lower, veneer sheet leading in the direction of movement the one there above and continuously feeding the so formed layup in the direction of movement into a drier where the veneer sheets while still in the layup are dried. The dried veneer sheets are then separated into discreet dried veneer sheets and are thereafter individually tested.

22 Claims, 3 Drawing Sheets

METHOD OF DRYING WOOD VENEER

FIELD OF INVENTION

This invention relates to drying of wood veneer, more particularly to drying of wood veneer by applying high frequency energy such as microwave energy

BACKGROUND OF THE INVENTION

Drying of veneer for laminating purposes including the formation of lamented veneer lumber (LVL) or products made by combining long strips of veneer under heat and pressure to form a relatively large cross section billet which may be later processed to form relatively strong lumber and/or beams such as those sold under the trademark "Parallam" by Weyerhaeuser Company, generally comprises drying the veneer one sheet at a time. Normally the veneer is dried by hot air jet drying i.e. blasting hot air against opposite side faces of the veneer. This requires a relatively long drier to provide sufficient time to complete the drying.

The veneer is dried to a low moisture content before it is made into a finished product, typically to between about 0.1% and 10% moisture on a weight of day wood basis. If the veneer dryness is outside of this narrow range the quality of the final product will likely be negatively impacted. Both too dry and too wet veneers have a negative impact.

Veneer sheets to be dried usually contain significantly different moisture contents both between different veneer sheet and locally within a single veneer sheet, and further generally do not have constant density throughout their areas, which makes uniform drying more difficult. Thus although the treatment is the same for all sheets it is not uncommon for the final moisture content in the dried veneer sheets to vary significantly both from sheet to sheet and internally (locally) within a given sheet and generally the sheets are separated based on wetness and the wetter sheets subjected to a redrying stage where the dried veneer still containing significant moisture (e.g. wet spots in the veneer) are redried.

Redrying may be done for example by passing the wet sheets through the same drier a second time and choosing a time and temperature to gain the desired result, but again the wetness of the individual sheets vary and it is difficult to set conditions to properly process these wet sheets.

It is also known to use radio frequency drying of a batch (pile of veneers) typically a 4 by 8 by 3 foot high stack of veneers (120 by 240 by 90 cm) or pass the sheets singly through a radio frequency drier, but both of these techniques while operative are not particularly effective It is known to apply high frequency energy such as microwave energy to heat or dry materials. For example in the above-described processes of making "Parallam" microwave energy is used and it is also sometimes used in making LVL.

In the manufacture of plywood and LVL it is the practice to offset the end of the veneer in adjacent layers to better insure there is no relatively weak section formed by a plurality of layer having the edges of the veneer in various layers aligned or close being aligned vertically through the finished product see fore example U.S. Pat. Nos. 3,963,552 issued Jun. 15, 1976 to Troutner et al. and 4,797,169 issued Jan. 10, 1989 to Alzawa et al.

BRIEF DESCRIPTION OF THE PRESENT INVENTION

It is an object of the invention to provide a veneer drying system to more uniformly dry the veneer.

It is a further object of the present invention to provide a more efficient drying system for veneer, which permits easy separation for individual testing of each veneer sheet or stacking for further use.

Broadly the presenting invention relates to a method of drying veneer sheets comprising, laying each succeeding single veneer sheet into overlying relation with its immediately preceding veneer sheet to form a layup of shingled veneer sheets with a said immediately preceding veneer sheet of said layup leading its said succeeding veneer sheet by a distance X of at least 1 inch (2.5 cm) and not more than 50% of the length of one of said veneer sheet, continuously feeding said layup into a drier in a direction substantially the same as the direction said immediately preceding veneer sheet leads its said succeeding veneer sheet, drying in said drier said veneer sheets forming said layup to provide dried veneer sheets, separating sequentially said dried preceding veneer sheets from their dried succeeding veneer sheets in said layup into discreet dried veneer sheets.

Preferably the drying stage will apply high frequency drying.

Preferably said high frequency drying will be microwave drying.

Preferably said high frequency drying will be radio frequency drying.

Preferably said veneer sheet have their grain direction substantially parallel to said direction.

Preferably said distance X is 1 foot (30 cm).

Preferably said laying and said feeding are coordinated so that said layup is between 5 and 25 veneer thicknesses as it moves through said drier and is dried.

Preferably said veneer sheets have faces with surface areas of at least 7 square feet (6300 square cm) and a thickness of between 1/16 and 3/16 inches (0.15 and 0.3 cm).

Preferably said separating comprises pinching said layup between a pair of bottom and top pinch rolls and continuing to move said layup in said direction by said pinch rolls conveying a lowermost veneer from said layup immediately after it passes off said bottom roll at a speed sufficient to singulate said lowermost veneer from said veneer remaining in said layup.

BRIEF DESCRIPTION OF THE SEVERAL VIEWS OF THE DRAWING(S)

Further features, objects and advantages will be evident from the following detailed description of the preferred embodiments of the present invention taken in conjunction with the accompanying drawings in which.

DETAILED DESCRIPTION OF THE INVENTION

Figure 1:
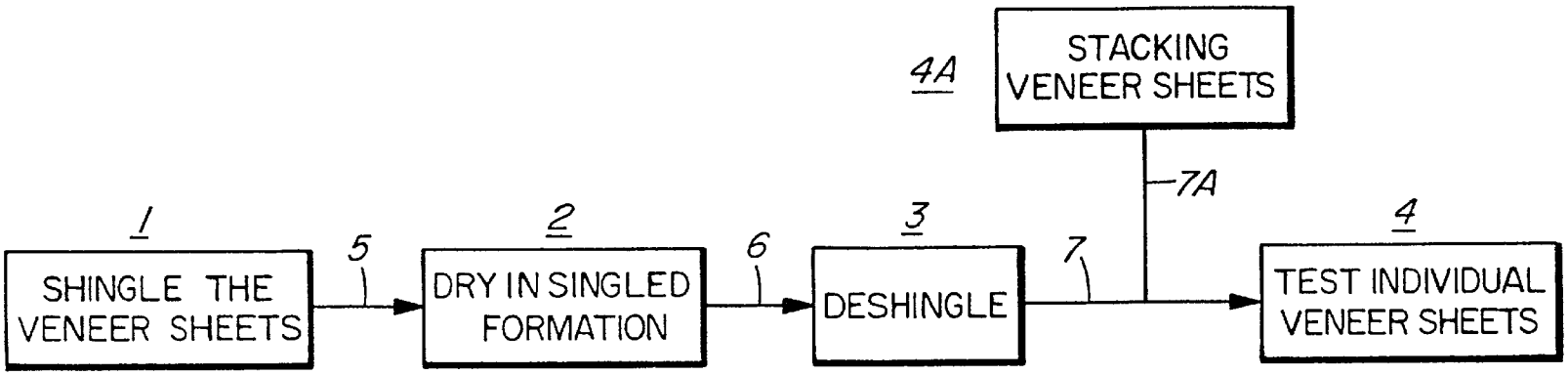
FIG. 1 is a flow diagram illustrating the sequence of steps of the present invention.

As shown in FIG. 1 the present invention relates to a method of drying wood veneer sheets where the discreet veneer sheets are continuously shingled as indicated at step 1 to form a layup 10 (see FIGS. 3 and 4) and the so formed layup is as indicated by the arrow 5 continuously fed into a drier wherein a drying step is performed as indicated by step 2 in FIG. 1. The drier or drying step 2 is preferably a drier or drying system wherein known techniques of drying such as radio frequency or microwave frequency drying is performed. The layup 10 is continuously removed from the drying step 2 and fed as indicated by the arrow 6 into a deshinging step 4 where the veneer sheets of the layup 10 are separated back into discrete sheets and these dried discrete sheets are preferably continuously fed as indicated by the arrow 7 directly into a testing stage 4 where each veneer is individually tested or alternatively as indicated by arrow 7A directly to a stacking stage 4A wherein the veneer is piled one on the other to form a stack of dried veneer sheets which later may be separated and tested and/or used as desired.

The veneer V of the present invention will have a thickness t; a length l measured in the grain direction; and a width w measured perpendicular to l, which normally will be t=0.05 to 0.25 inches (0.12 to 0.65 cm);

l=10 to 110 inches (25 to 280 cm); and w=10 to 100 inches (25 to 260 cm)

Figure 2:
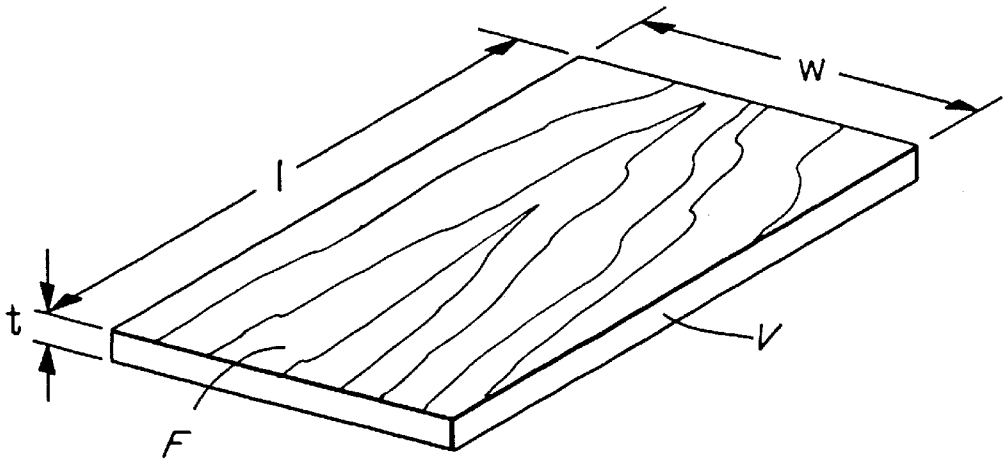
FIG. 2 is an isometric illustration of a typical veneer sheet to be drier by the method of the invention.

(see FIG. 2). Which means the face area F will generally be between about 1 and 50 square feet (645 and 32000 square cm)

Figure 3:
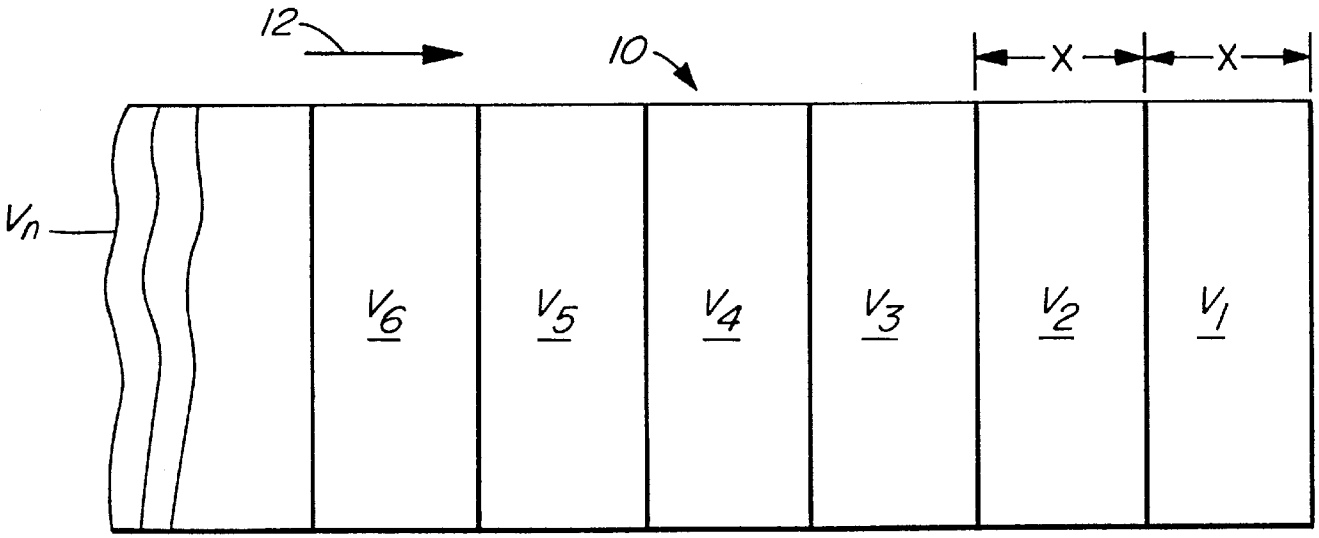
FIG. 3 is a schematic plan view of a shingled layup in a form to be dried using the present invention.
Figure 4:
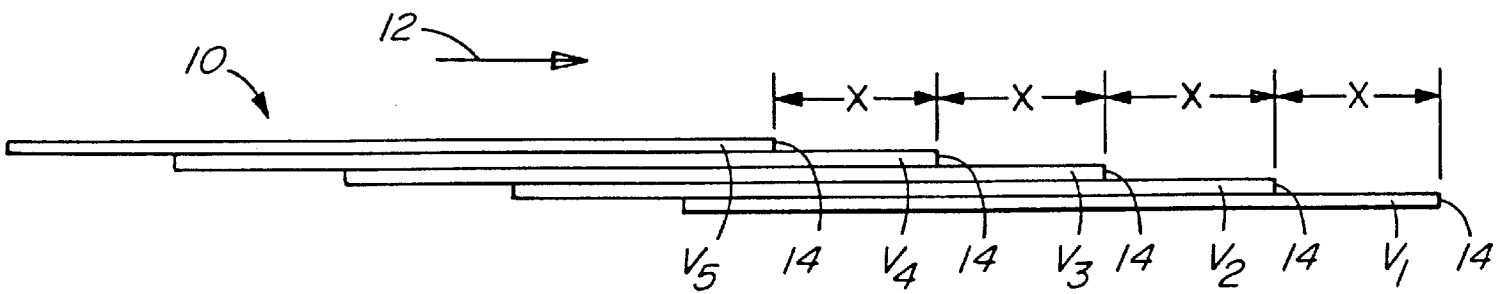
FIG. 4 is a schematic side elevation showing the singled relationship of the veneer forming the layup.
Figure 5:
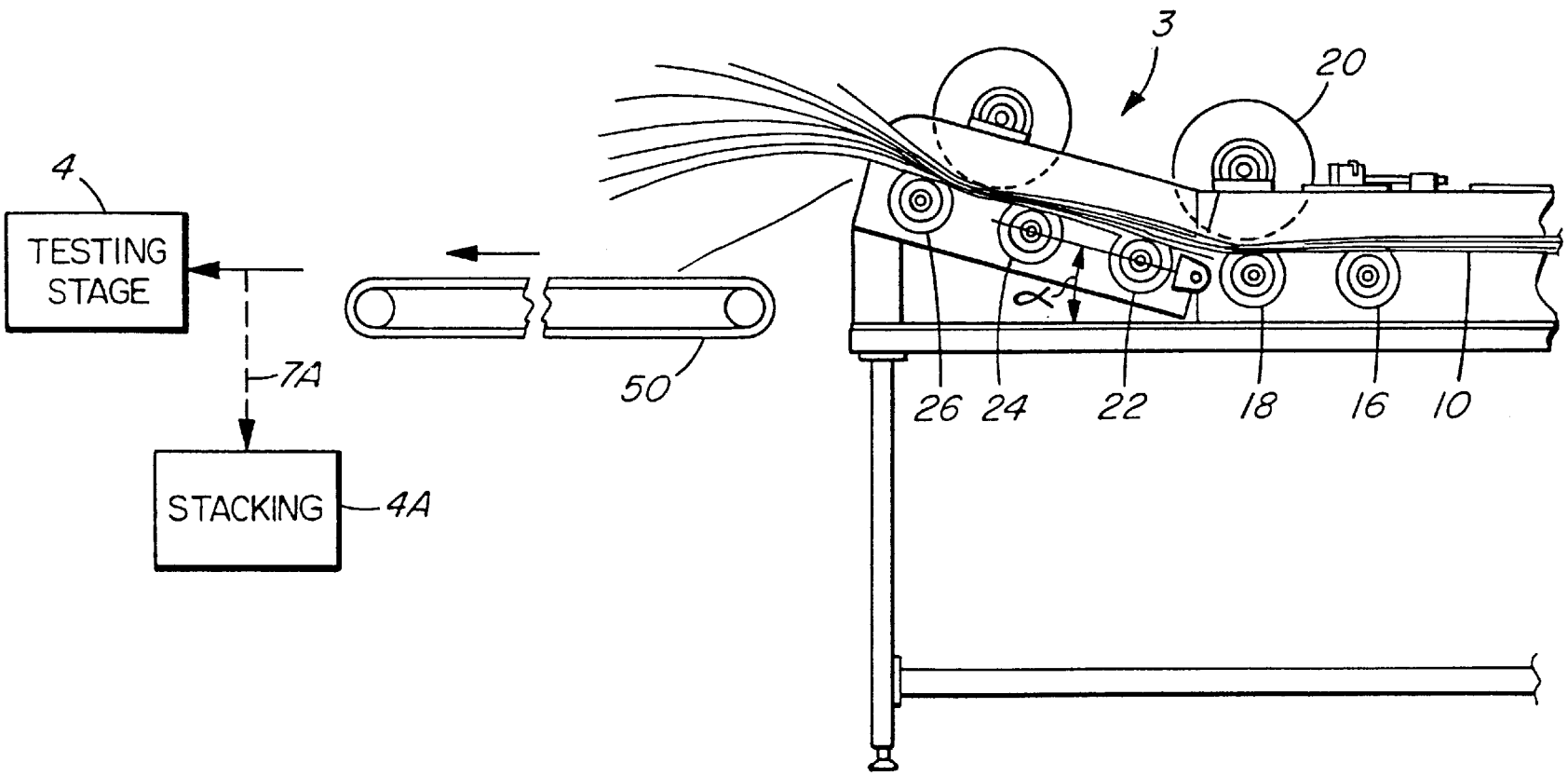
FIG. 5 shows a preferred form of deshingler for separating the dried veneer in the layup into discrete veneer sheets for testing or stacking.

As illustrated in FIG. 3 and 4 the layup 10- is composed of a plurality of discreet wood veneer sheets $V_1$ $V_2$ $V_3$ $V_4$ $V_5$ $V_6$ - - - $V_n$ piled one after the other in sequence in shingled relationship. As shown the first veneer $V_1$ which forms the immediately preceding veneer for the following or immediately succeeding single veneer sheet $V_2$ which then forms the immediately preceding veneer for the following or immediately succeeding single veneer sheet $V_3$ and so on for each subsequent veneer in the sequence of veneer sheets.

The veneer sheets are shingled so that the immediately preceding veneer sheet has its leading free edge 14 (leading in the direction of movement of the layup through the process as indicated by the arrow 14) in front of the leading free edge 14 of the following or immediately succeeding single veneer sheet by a distance X i.e. the free edge 14 of veneer $V_1$ leads the free edge 14 of veneer sheet $V_2$ by distance X and the free edge 14 of veneer sheet $V_2$ leads the free front edge 14 of veneer $V_3$ by the distance X and so on for the length of the layup.

Preferably the distance X will be substantially the same throughout the length of the layup measured in the direction of the arrow 12. Obviously there will be some variation, as the shingling operation will normally be done manually. The length of the dimension X will be at least 1 inch (2.5 cm) and will not exceed 50% of the length l.

As above indicated the shingled layup 10 is fed through and dried in the drying stage 2 and the dried layup composed of dried veneer sheets is continuously fed into the deshingling stage or step 3. For the drying stage 2 to be most effective the thickness of the layup passing through the drying stage will be in the range of between 5 and 25 veneer thicknesses.

In the preferred arrangement of the present invention the deshingling stage is formed by a first bottom guide roller 16 delivering the dried layup 10 to a bottom nip or pressure roll 18 that forms a pressure nip with the top pressure roll 20 and the layup tends to follow the roll 20 and is deflected to a sequence (in the illustrated arrangement 3) guide rolls 22, 24 and 26 having their axes arranged in a straight line extending at an angle $\alpha$ to the plane containing the axes of the rolls 16 and 18. $\alpha$ will generally be in the range of 0 to 30 degrees.

A second top pressure roll applies pressure to the top of the layup 10 and forms a nip with the last roll 26 in the sequence of rollers to splay the veneers apart and to feed the bottom veneer off free of the next higher veneer in the sequence of veneers of the layup 10. The bottom veneers are in sequence received by the conveyor 50 which is a high speed conveyor that moves the bottom veneer out of the way so that the next bottom veneer is received on the conveyor in non overlapping relationship i.e. the dried veneers are deshingled. The conveyor 50 delivers the deshingled dried veneers one after the other into the testing stage 4 where the individually veneers may be tested in any suitable manner e.g. stress tested, tested for moisture content and variation, etc. or the stacking stage 4A where the veneer is piled for future use or testing as described for stage 4. Any suitable form of stacking mechanism may be used.

Having described the invention, modifications will be evident to those skilled in the art without departing from the scope of the invention as defined in the appended claims.

We claim:

1. A method of drying veneer sheets comprising, laying each succeeding single veneer sheet into overlying relation with its immediately preceding veneer sheet to form a layup of shingled veneer sheets with a said immediately preceding veneer sheet of said layup leading its said succeeding veneer sheet by a distance X of at least 1 inch (2.5 cm) and not more than 50% of the length of one of said veneer sheet, continuously feeding said layup into a drier in a direction substantially the same as the direction said immediately preceding veneer sheet leads its said succeeding veneer sheet, drying in said drier said veneer sheets forming said layup to provide dried veneer sheets, separating sequentially said dried preceding veneer sheets from their dried succeeding veneer sheets in said layup into discreet dried veneer sheets.

2. A method as defined in claim 1 wherein said drier applies high frequency drying.

3. A method as defined in claim 2 wherein said high frequency drying comprises microwave drying.

4. A method as defined in claim 2 wherein said high frequency drying comprises radio frequency drying.

5. A method as defined in claim 2 wherein said veneer sheets have their grain direction substantially parallel to said direction.

6. A method as defined in claim 3 wherein said veneer sheets have their grain direction substantially parallel to said direction.

7. A method as defined in claim 4 wherein said veneer sheets have their grain direction substantially parallel to said direction.

8. A method as defined in claim 1 wherein said laying and said feeding are coordinated so that said layup is between 5 and 25 veneer thicknesses as the layers move through said drier and is dried.

9. A method as defined in claim 2 wherein said laying and said feeding are coordinated so that said layup is between 5 and 25 veneer thicknesses as the layers moves through said drier and is dried.

10. A method as defined in claim 3 wherein said laying and said feeding are coordinated so that said layup is between 5 and 25 veneer thicknesses as the layers moves through said drier and is dried.

11. A method as defined in claim 4 wherein said laying and said feeding are coordinated so that said layup is between 5 and 25 veneer thicknesses as the layers moves through said drier and is dried.

12. A method as defined in claim 5 wherein said laying and said feeding are coordinated so that said layup is between 5 and 25 veneer thicknesses as the layers moves through said drier and is dried.

13. A method as defined in claim 6 wherein said laying and said feeding are coordinated so that said layup is between 5 and 25 veneer thicknesses as the layers moves through said drier and is dried.

14. A method as defined in claim 7 wherein said laying and said feeding are coordinated so that said layup is between 5 and 25 veneer thicknesses as the layers moves through said drier and is dried.

15. A method as defined in claim 1 wherein said veneer sheets have faces with surface areas F of at least 7 square feet (45 square cm) and a thickness of between 1/16 and 3/16 inches (0.15 and 0.3 cm).

16. A method as defined in claim 2 wherein said veneer sheets have faces with surface areas F of at least 7 square feet (45 square cm) and a thickness of between 1/16 and 3/16 inches (0.15 and 0.3 cm).

17. A method as defined in claim 3 wherein said veneer sheets have faces with surface areas F of at least 7 square feet (45 square cm) and a thickness of between 1/16 and 3/16 inches (0.15 and 0.3 cm).

18. A method as defined in claim 4 wherein said veneer sheets have faces with surface areas F of at least 7 square feet (45 square cm) and a thickness of between 1/16 and 3/16 inches (0.15 and 0.3 cm).

19. A method as defined in claim 1 wherein said separating comprises pinching said layup between a pair of bottom and top pinch rolls and continuing to move said layup in said direction by said pinch rolls conveying a lowermost veneer from said layup immediately after the lowermost veneer passes off said bottom roll at a speed sufficient to seperate said lowermost veneer from said veneer remaining in said layup.

20. A method as defined in claim 2 wherein said separating comprises pinching said layup between a pair of bottom and top pinch rolls and continuing to move said layup in said direction by said pinch rolls conveying a lowermost veneer from said layup immediately after the lowermost veneer passes off said bottom roll at a speed sufficient to seperate said lowermost veneer from said veneer remaining in said layup.

21. A method as defined in claim 3 wherein said separating comprises pinching said layup between a pair of bottom and top pinch rolls and continuing to move said layup in said direction by said pinch rolls conveying a lowermost veneer from said layup immediately after the lowermost veneer passes off said bottom roll at a speed sufficient to seperate said lowermost veneer from said veneer remaining in said layup.

22. A method as defined in claim 4 wherein said separating comprises pinching said layup between a pair of bottom and top pinch rolls and continuing to move said layup in said direction by said pinch rolls conveying a lowermost veneer from said layup immediately after the lowermost veneer passes off said bottom roll at a speed sufficient to seperate said lowermost veneer from said veneer remaining in said layup.

* * * * *